US007993176B2

(12) United States Patent
Lunde

(10) Patent No.: US 7,993,176 B2
(45) Date of Patent: Aug. 9, 2011

(54) SUBMERSIBLE MOORING SYSTEM

(75) Inventor: Peter Alan Lunde, Cypress, TX (US)

(73) Assignee: Seahorse Equipment Corp, Houston, TX (US)

( * ) Notice: Subject to any disclaimer, the term of this patent is extended or adjusted under 35 U.S.C. 154(b) by 287 days.

(21) Appl. No.: 12/264,737

(22) Filed: Nov. 4, 2008

(65) Prior Publication Data

US 2009/0209154 A1 Aug. 20, 2009

Related U.S. Application Data

(60) Provisional application No. 61/029,817, filed on Feb. 19, 2008.

(51) Int. Cl.
*B63B 22/02* (2006.01)

(52) U.S. Cl. ..... 441/5; 441/3; 441/23

(58) Field of Classification Search ..... 441/3, 5, 441/23, 4; 405/195.1, 223.1, 224, 224.2
See application file for complete search history.

(56) References Cited

U.S. PATENT DOCUMENTS

| | | | | |
|---|---|---|---|---|
| 4,266,500 | A | 5/1981 | Jurca | |
| 4,892,495 | A | 1/1990 | Svensen | |
| 5,041,038 | A * | 8/1991 | Poldervaart et al. | 441/5 |
| 5,044,297 | A * | 9/1991 | de Baan et al. | 441/4 |
| 5,275,510 | A * | 1/1994 | de Baan et al. | 405/171 |
| 5,431,589 | A | 7/1995 | Corona | |
| 6,062,769 | A | 5/2000 | Cunningham | |
| 6,558,215 | B1 * | 5/2003 | Boatman | 441/5 |
| 6,811,355 | B2 * | 11/2004 | Poldervaart | 405/224.2 |
| 7,614,927 | B2 * | 11/2009 | Olsen et al. | 441/5 |
| 7,770,532 | B2 * | 8/2010 | Bauduin et al. | 114/230.2 |
| 2004/0161303 | A1 | 8/2004 | Baan et al. | |

* cited by examiner

*Primary Examiner* — Lars A Olson
(74) *Attorney, Agent, or Firm* — Wong, Cabello, Lutsch, Rutherford & Brucculeri, L.L.P.

(57) ABSTRACT

A submersible mooring buoy for a floating vessel comprises a compartmented hull; a plurality of non-buoyant, catenary anchor lines each connected to the hull and a spring buoy such that the hull may be submerged without sinking to the seafloor by flooding selected compartments; and, a plurality of mooring legs anchoring each spring buoy to the seafloor.

8 Claims, 3 Drawing Sheets

Submerged Configuration

Normal Operating Configuration

Submerged Configuration

Installation
Initial Connection of CALM Buoy

SUBMERSIBLE MOORING SYSTEM

CROSS-REFERENCE TO RELATED APPLICATIONS

This application claims the benefit of U.S. Provisional Patent Application No. 61/029,817 filed Feb. 19, 2008, and entitled: "Submersible Mooring System for Tankers."

STATEMENT REGARDING FEDERALLY SPONSORED RESEARCH OR DEVELOPMENT

NOT APPLICABLE

BACKGROUND OF THE INVENTION

1. Field of the Invention

This invention relates to mooring a floating vessel. More particularly, it relates to a mooring buoy which may be submersed to protect the buoy and associated submarine hose from extreme weather or sea conditions.

2. Description of the Related Art Including Information Disclosed Under 37 CFR 1.97 and 1.98

Certain mooring systems of the prior art comprise anchored, floating buoys to which vessels may connect. However, such buoys are subject to whatever metocean conditions may exist at their location and are susceptible to damage from wind and wave action.

U.S. Pat. No. 5,431,589 describes a single-point submersible mooring buoy for use in ice-infested and severe sea state anchorages for transferring fluids between marine tankers and fluid handling facilities. The device includes a buoy body having a rotatable turntable disposed thereon for supporting a hose reel and a mooring hawser and associated winch. The buoy includes onboard anchor chain windlasses for maintaining anchor chain tension in the surfaced as well as submerged positions. Ballast tanks, compressed air reservoirs, hydraulic pumps and motors are disposed on the buoy and may be operated by remote control to move the buoy between floating and submerged positions and to provide for connecting and disconnecting the fluid transfer hose and mooring hawser with respect to a vessel such as a tanker.

U.S. Pat. No. 4,892,495 describes a subsurface buoy loading system for offshore oil gas production from production wells in the sea bottom. One or more flexible risers lead from the respective production wells to a submersible buoy adapted to be fitted to a complementary loading vessel in order to transfer petroleum products from the production wells via the loading buoy to the cargo space in the vessel. When not carrying out loading operations, the loading buoy may be descended down into an equilibrium position in the body of water. In the loading vessel, the buoy is fitted into a rotatable turret seat located in a downwardly open tunnel in the ship hull. The rotatable turret seat is positioned at such a level that the top side of the buoy, when in the loading position, is situated above sea level. The riser or risers extend through a vertical shaft in the buoy and are attached to the top of the buoy. The rotatable turret seat supports pipes communicating between the risers and a receiving pipeline system in the vessel.

U.S. Pat. No. 4,266,500 describes a compressed fluid hover control system for a submersible buoy in which the water level in a buoyancy chamber is controlled in accordance with external water pressure and predetermined levels of water in the buoyancy chamber. More specifically, a submersible buoy having a fluid-containing chamber containing a compressed fluid is connected to a buoyancy chamber by a gas inlet valve.

A gas exhaust valve connects an upper portion of the buoyancy chamber to the surrounding water and a relief duct connects a lower portion of the buoyancy chamber to the surrounding water. Both the gas inlet and gas exhaust valves are controlled by a valve control circuit which opens and closes the valves in accordance with predetermined criteria related to water levels within the buoyancy chamber and the depth of the buoy as determined by a water pressure transducer. The valve control circuit thus causes the buoy to oscillate between predetermined depth levels, those levels changing as the compressed fluid is expended in order to maximize the operating life of the buoy.

U.S. Patent Publication No. 2004/0161303 describes a catenary anchor leg mooring system that includes a cylindrical hull portion which reduces the tendency of the cylindrical hull to roll and pitch in response to the action of winds and waves. This motion reduction is said to come from changing the diameter and draft of the cylindrical hull.

U.S. Pat. No. 6,062,769 describes a steel catenary riser system for use in an arrangement which includes a floating vessel such as a Floating Production, Storage and Offloading (FPSO) vessel floating on the sea surface and secured to the seabed by means of anchor legs which substantially prevent rotation of a turret which is rotationally supported on the vessel. The vessel is thus capable of weathervaning about the stationary turret under forces of wind, currents and waves. Steel Catenary Risers (SCR) run from the seabed sources of hydrocarbons to a Steel Catenary Riser Interface Buoy, called a "SCRIB". A flexible riser hose, which may be suspended in a double catenary configuration, is coupled to each SCR at a SCRIB. The upper end of each flexible riser runs to the turret and connects to a fluid coupling (i.e., a swivel) and then via a pipe to a vessel holding tank. A cross-link is placed between two or more steel tubular lines in order to enhance the stability of the riser system. Devices are coupled to the steel tubular lines for increasing their tension in order to increase the natural frequency of vibration in order to reduce sensitivity to vortex induced vibration.

BRIEF SUMMARY OF THE INVENTION

A submersible mooring buoy for a floating vessel comprises a compartmented hull; a plurality of non-buoyant, catenary anchor lines each connected to the hull and a spring buoy such that the hull may be submerged without sinking to the seafloor by flooding selected compartments; and, a plurality of mooring legs anchoring each spring buoy to the seafloor. In this way, the buoy may be submerged below the surface and remain at a controlled depth during periods of extreme and potentially damaging wind and wave conditions.

BRIEF DESCRIPTION OF THE SEVERAL VIEWS OF THE DRAWING(S)

DETAILED DESCRIPTION OF THE INVENTION

Figure 1:
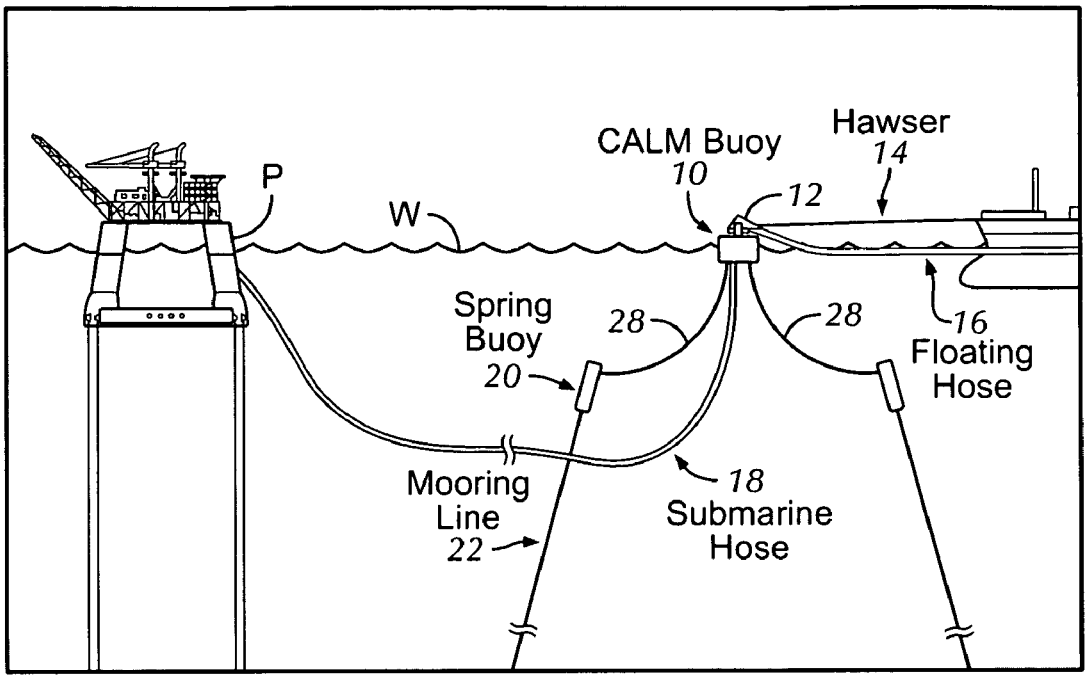
FIG. 1 shows a buoy of the present invention in an operating condition wherein a tanker is moored to the buoy by a hawser, the buoy is anchored by a system comprising spring buoys, and the buoy is in fluid communication with both an offshore production platform and a tanker, FPSO or similar vessel.

The invention may best be understood by reference to the representative embodiment shown in the drawing figures wherein an offshore production platform P is in fluid communication with submersible mooring buoy 10. Buoy 10, in its normal operating condition, floats on water surface W.

Figure 2:
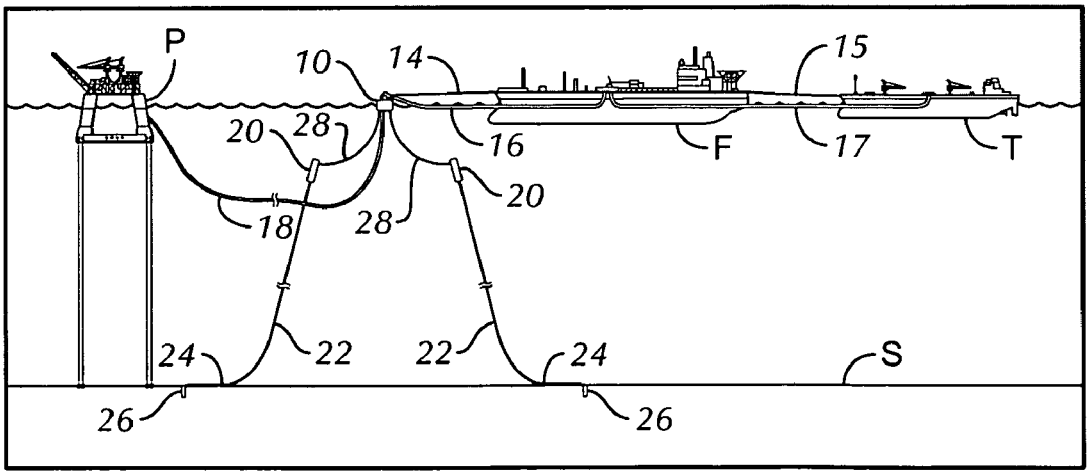
FIG. 2 shows the system illustrated in FIG. 1 with the addition of a tanker in fluid communication with an FPSO moored to the submersible buoy.

As shown in FIGS. 1 and 2, the present invention comprises a tanker mooring system which has certain features that are similar to conventional Catenary Anchor Leg Mooring (CALM) systems used for loading and unloading moored tanker vessels. A tanker or other vessel such as a Floating Production, Storage and Offloading vessel (FPSO) may be moored to the CALM buoy 10 by a hawser 14. CALM buoy 10 may comprise turntable 12 which is adapted to rotate relative to the hull of buoy 10. Hawser 14 may be attached to turntable 12 on buoy 10 so as to permit a vessel moored to buoy 10 to weathervane freely around CALM buoy 10. The product may be transferred between the tanker and the CALM buoy 10 by a floating hose 16 connected to turntable 12 on buoy 10 via a swivel fitting, as is conventional in the art. The CALM buoy 10 may be connected to the source of the product or to the storage facility by a submerged pipeline consisting at least partially of a flexible underwater hose 18 or a riser system.

FIG. 2 depicts a typical operating configuration in which hydrocarbon product flows from production platform P to buoy 10 via submarine hose 18. The product then flows via floating hose 16 to FPSO vessel F which is moored to buoy 10 by hawser 14. Product may be transferred from FPSO vessel F to tanker T moored by line 15 via floating hose 17.

The present invention allows a CALM buoy to be submerged before the onset of extreme environmental events such as hurricanes or ice conditions. The submerged condition during severe storms protects the buoy from wave loading and reduces the motions of the buoy. The reduced motions result in reduced loads and motions on the connected submarine hose or riser system.

This invention allows the CALM buoy 10 to be submerged to a desired depth by flooding selected compartments of the buoy. Compartments in the lower part of buoy 10 may be flooded such that the center of buoyancy of buoy 10 remains above its center of gravity so as to provide stability of the buoy 10 in its submerged configuration. The buoy 10 is stable at the desired depth due to the transfer of the weight of the upper mooring legs 28 to the submerged "spring" buoys 20 that are part of the mooring legs. As buoy 10 descends, a greater portion of the weight of upper mooring legs 28 is borne by spring buoys 20 and buoy 10 will therefore descend to and maintain an equilibrium depth.

Figure 3:
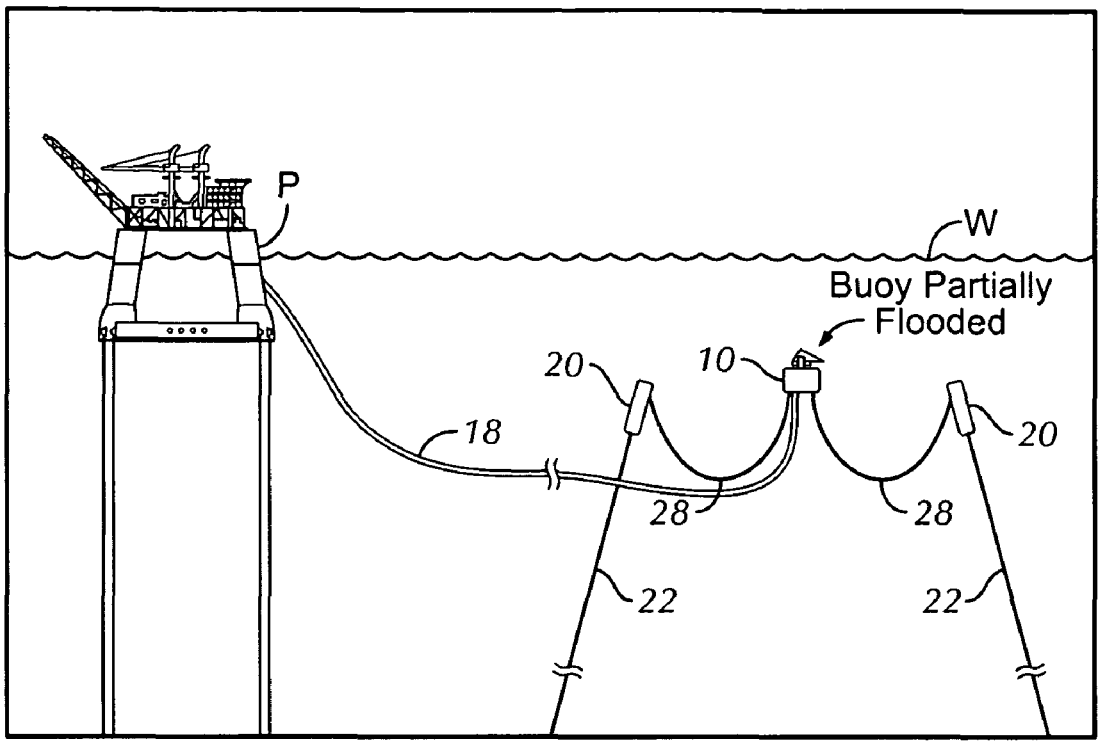
FIG. 3 illustrates the buoy of the present invention in its submersed condition for protection from the environmental conditions existing on the surface.
Figure 4:
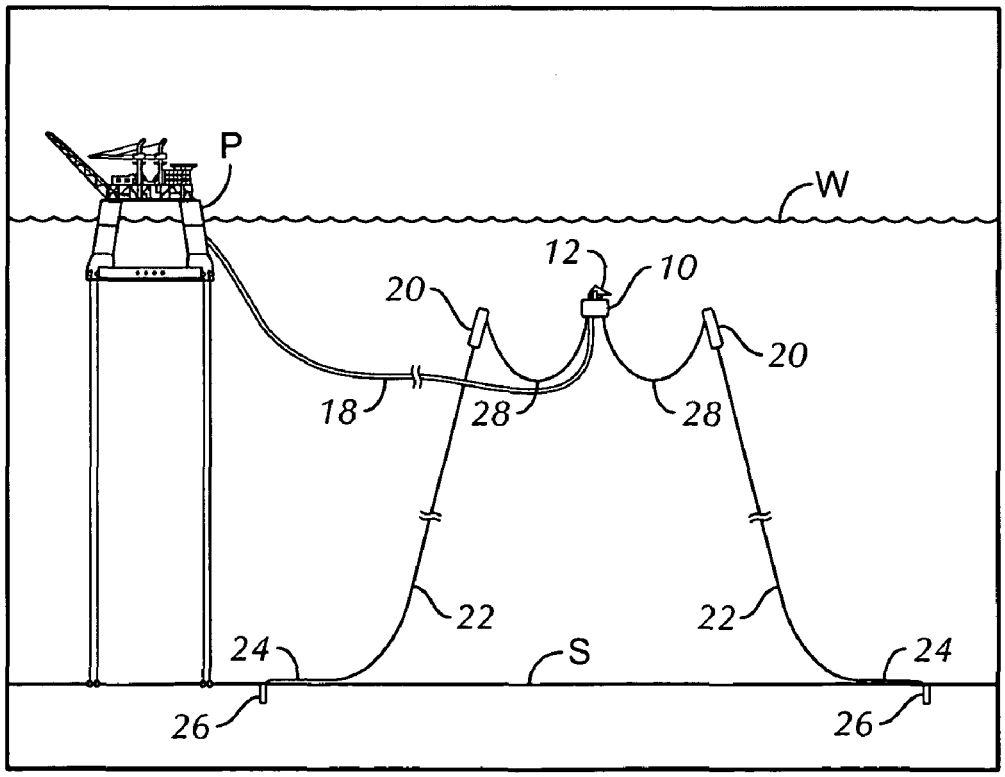
FIG. 4 is a larger-scale view of the buoy system shown in FIG. 3.

In one particular preferred embodiment, upper anchor lines 28 comprise chain. The chain is sized to provide not only sufficient holding strength, but also sufficient weight to stabilize buoy 10 at the desired depth when submerged. As shown in FIGS. 3 and 4, the anchor system comprised of spring buoy 20, lower leg 22 and upper leg 28 may assume an inverted or double catenary configuration when buoy 10 is submerged. It will be appreciated by those skilled in the art that other materials having a density greater than sea water may be used in this application.

Following submersion, mooring buoy 10 may be re-floated by de-ballasting the flooded compartments of buoy 10 by means of an air hose (or other conduit) from a workboat or other vessel, by self-contained compressed gas, by on-board gas generation means or by a hose from the platform P. After refloating the buoy, the hawser 14 and floating hose 16 (if removed prior to submerging) can be reconnected at the surface using workboats or other means conventional in the art.

The system may have three or more mooring legs. In one particular preferred embodiment, the mooring legs are made up of: an anchor 26, a bottom chain length 24 (with a portion on seafloor S), a polyester section 22 (for deep water) and a spring buoy 20. The upper mooring leg 28 from the CALM buoy 10 to the spring buoy 20 may comprise chain to provide stabilizing weight when buoy 10 is submerged.

In an alternative embodiment, spring buoys 20 may be moored to anchors 26 in a taut configuration—i.e., anchor lines 22 are substantially straight and do not assume a catenary configuration. In such embodiments, portion 24 of the anchor line is eliminated and no portion of the anchor line lies on the seafloor when CALM buoy 10 is either floating on the surface or submerged.

The spring buoys 20 and the upper mooring legs 28 may be eliminated and the mooring legs connected directly to buoy 10 if mooring legs 22 have the proper weight to result in the desired submerged buoy depth when the buoy is flooded (but still positively buoyant). As buoy 10 descends, the portion 24 of anchor leg 22 resting on seafloor S becomes a greater percentage of the total anchor length and the effective weight of the anchor leg supported by buoy 10 decreases. Hence, buoy 10 will reach an equilibrium depth where its (reduced) buoyancy equals the total combined effective weight of anchor legs 22 and submarine hose 18 and where it will remain until such time as it is deballasted.

Figure 5:
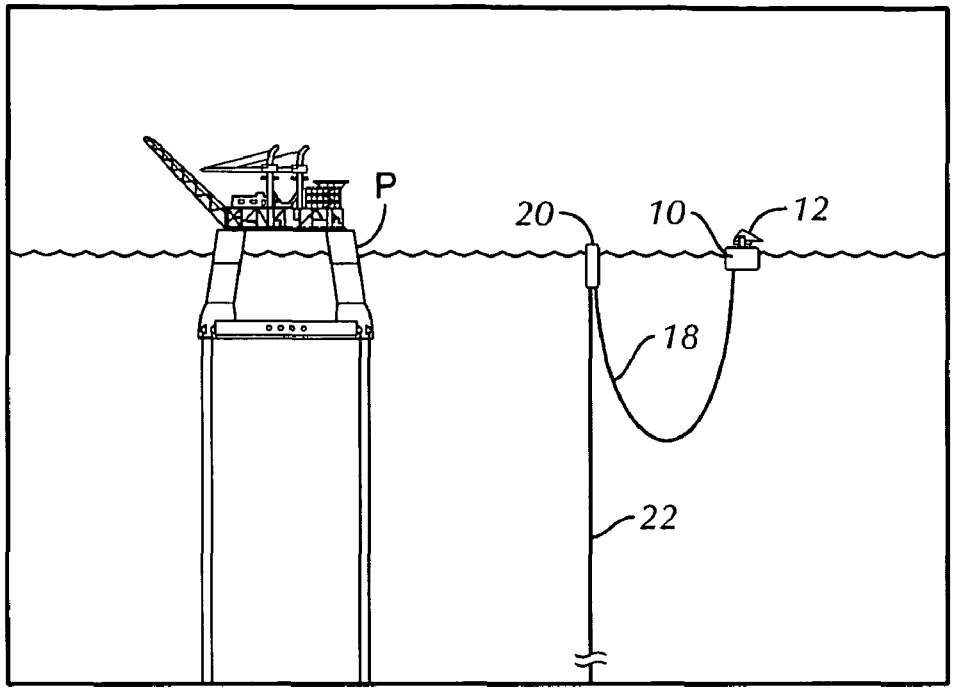
FIG. 5 shows a step in the installation process of a buoy according to the invention wherein the buoy has been connected to one spring buoy.
Figure 6:
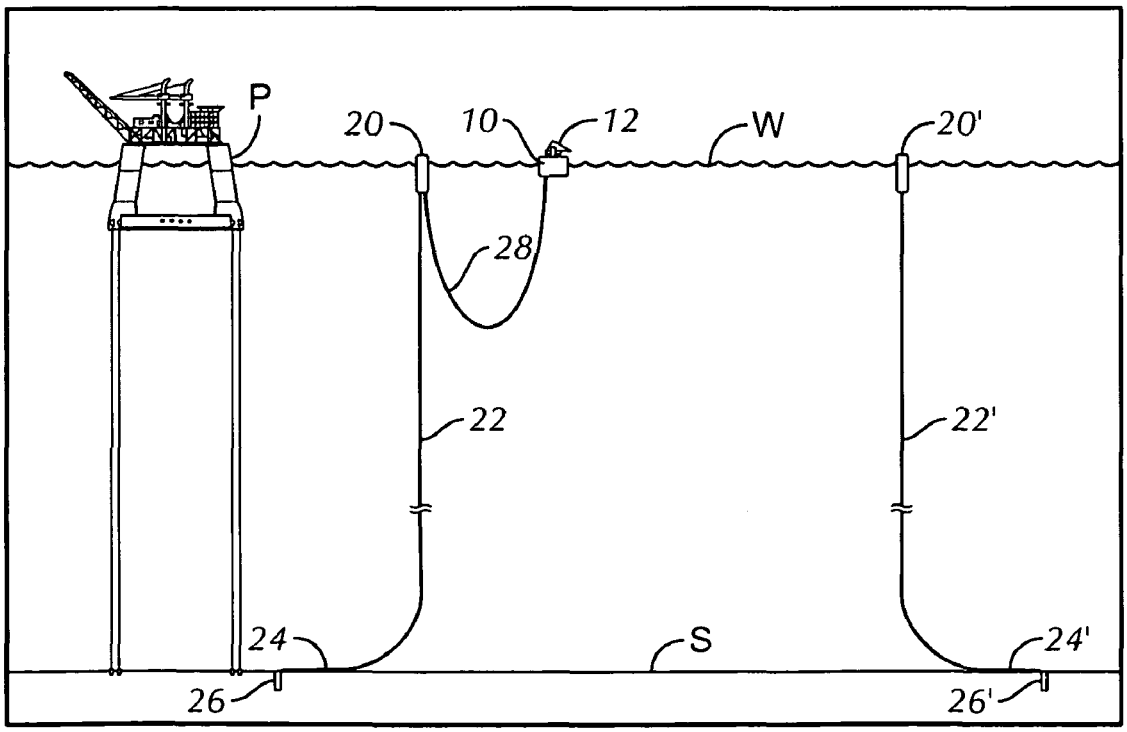
FIG. 6 shows a step in the installation process of a buoy according to the invention wherein the buoy is connected to one spring buoy and a second spring buoy is positioned for connection to the buoy.

The anchors 26 and mooring legs 22 can be preinstalled. One particular preferred installation method is illustrated in FIGS. 5 and 6. The mooring leg 22 may be supported by a spring buoy 20 floating on the water surface W, or below the surface. The connection of the CALM buoy 10 to the mooring system and subsequent connection of the submerged hose 18, floating hose 16 and hawser 14 can be accomplished on the surface in the same manner as done for conventional CALM systems. As shown in FIG. 5, buoy 10 may be initially connected to a first anchored spring buoy 20 and subsequently to a second anchored spring buoy 20'. Additional spring buoys may be connected in similar fashion. Mooring and cargo transfer operations using the system may be accomplished by conventional procedures used at terminals.

Although the invention has been described in detail with reference to certain preferred embodiments, variations and modifications exist within the scope and spirit of the invention as described and defined in the following claims.

What is claimed is:

1. A method of protecting a mooring buoy from surface conditions comprising:

attaching the buoy to a plurality of spring buoys with non-buoyant anchor lines in a catenary configuration;

ballasting the buoy to cause it to sink to an equilibrium depth at which its buoyancy is substantially equal to the combined effective weight of the anchor lines supported by the buoy; and, de-ballasting the buoy sufficiently to cause it to float on the surface following a period of submergence by adding pressurized gas via a conduit from a workboat to flotation chambers within the buoy.

2. A method of protecting a mooring buoy as recited in claim 1 wherein the non-buoyant, catenary anchor lines comprise chain.

3. A method of protecting a mooring buoy as recited in claim 1 wherein the non-buoyant, catenary anchor lines consist of chain.

4. A method of protecting a mooring buoy as recited in claim 1 wherein the spring buoys are fully submerged in their normal operating condition.

5. A method of protecting a mooring buoy as recited in claim 1 wherein the mooring buoy comprises a hull that is compartmented and selected compartments are ballasted to submerge the buoy such that the center of buoyancy of the buoy is above the center of gravity of the buoy.

6. A method of protecting a mooring buoy as recited in claim 1 wherein the buoy comprises a hull and ballasting the buoy comprises flooding at least a portion of the hull.

7. A method of protecting a mooring buoy as recited in claim 5 wherein ballasting comprises flooding selected compartments.

8. A method of protecting a mooring buoy from surface conditions comprising:

attaching the buoy to a plurality of spring buoys with non-buoyant anchor lines in a catenary configuration;

ballasting the buoy to cause it to sink to an equilibrium depth at which its buoyancy is substantially equal to the combined effective weight of the anchor lines supported by the buoy; and, de-ballasting the buoy sufficiently to cause it to float on the surface following a period of submergence by adding pressurized gas via a conduit from a platform proximate the buoy to flotation chambers within the buoy.

* * * * *